US011932989B2

(12) United States Patent
Zhou et al.

(10) Patent No.: US 11,932,989 B2
(45) Date of Patent: Mar. 19, 2024

(54) PROCESS FOR PRODUCING REFINED COTTON WITH HIGH POLYMERIZATION DEGREE

(71) Applicant: HUBEI JINHANJIANG REFINED COTTON CO., LTD., Hubei (CN)

(72) Inventors: Hangxu Zhou, Hubei (CN); Zongqing Fan, Hubei (CN); Jintao Fan, Hubei (CN)

(73) Assignee: HUBEI JINHANJIANG REFINED COTTON CO., LTD. (CN)

( * ) Notice: Subject to any disclaimer, the term of this patent is extended or adjusted under 35 U.S.C. 154(b) by 0 days.

(21) Appl. No.: 17/885,313

(22) Filed: Aug. 10, 2022

(65) Prior Publication Data

US 2023/0046123 A1 Feb. 16, 2023

(51) Int. Cl.

| | |
|---|---|
| ***D21C 5/00*** | (2006.01) |
| ***D21C 1/06*** | (2006.01) |
| ***D21C 3/00*** | (2006.01) |
| ***D21C 3/02*** | (2006.01) |
| ***D21C 3/22*** | (2006.01) |
| ***D21C 7/10*** | (2006.01) |
| ***D21C 9/02*** | (2006.01) |
| ***D21C 9/14*** | (2006.01) |

(52) U.S. Cl.

CPC ..... *D21C 5/00* (2013.01); *D21C 1/06* (2013.01); *D21C 3/003* (2013.01); *D21C 3/022* (2013.01); *D21C 3/222* (2013.01); *D21C 7/10* (2013.01); *D21C 9/02* (2013.01); *D21C 9/142* (2013.01)

(58) Field of Classification Search

CPC ..... D21C 3/022; D21C 3/222; D21C 9/02; D21C 9/142; D21C 9/123; D21C 5/00

See application file for complete search history.

(56) References Cited

U.S. PATENT DOCUMENTS

| | | | | |
|---|---|---|---|---|
| 2,415,938 A * | 2/1947 | Deinet | C09B 5/30 | 548/219 |
| 5,449,436 A * | 9/1995 | Bourson | D21C 9/1057 | 162/84 |
| 6,023,065 A * | 2/2000 | Garver, Jr. | D21C 9/1052 | 250/372 |
| 9,499,940 B2 * | 11/2016 | Zhou | D21C 1/06 | |
| 2023/0234258 A1 * | 7/2023 | Hu | B27K 3/16 | 264/134 |

* cited by examiner

*Primary Examiner* — Anthony Calandra

(57) ABSTRACT

A process for producing refined cotton with a high polymerization degree includes: a. selection of material; b. impurity removal; c. impregnation; d. pretreatment: compounding triethanolamine, sodium carbonate, copper sulfate and magnesium oxide in equal proportion to form a cooking compound adjuvant with a mass concentration of 0.2-0.5%, putting the cooking compound adjuvant into a spherical digester together with the cotton linter subjected to the impregnation treatment, heating to 70 C, stopping heating, and subjecting to idling pretreatment for 40-60 min; e. cooking; f. cooling of the spherical digester; g. formulating a chlorine dioxide bleaching stabilization solution; h. a first stage of bleaching; I. alkali treatment; J. a second stage of bleaching; K. dechlorination; and l. rolling and drying by baking.

8 Claims, No Drawings

PROCESS FOR PRODUCING REFINED COTTON WITH HIGH POLYMERIZATION DEGREE

CROSS-REFERENCE TO RELATED APPLICATIONS

This application claims priority to Chinese Application No. 202110932014.7, having a filing date of Aug. 13, 2021, the entire contents of which are hereby incorporated by reference.

FIELD

The present invention relates to the technical field of refined cotton production process, and in particular to the technical field of production process of high polymerization degree refined cotton with a polymerization degree of more than 2,800.

BACKGROUND

Refined cotton is made by refining a cotton linter as a raw material via alkali cooking. It is the basic material for manufacturing ether cellulose, nitrocellulose, cellulose acetate and nano-cellulose. It is widely used in many fields such as food, medicine, clothing, military industry, daily chemicals, plastics, electronics, paper making, metallurgy, aerospace and the like. It is an indispensable new material for national economic development. Because traditional high-temperature alkali cooking and bleaching processes such as sodium hypochlorite and chlorine dioxide are difficult to control pulp degradation, it is very difficult to produce high viscosity and high polymerization degree, i.e., the viscosity exceeding 2,200 mPa·s and the polymerization degree exceeding 2,800, which restricts the upgrading of refined cotton to high viscosity and high polymerization degree.

In a method for producing ultra-high viscosity refined cotton of Chinese patent CN201110141806.9 and a process for producing ultra-high viscosity refined cotton of Chinese patent CN201310140702.5, sodium alkylbenzene sulfonate is used as an emulsifier in a process of cooking, sodium chlorite and hydrogen peroxide are combined for bleaching, and the viscosity produced by the process is only more than 1,500 mPa·s.

In a method for preparing ultra-high viscosity refined cotton of Chinese patent CN201210295256.0 and a process for producing ultra-high viscosity refined cotton of Chinese patent CN200410013451.5, the viscosity of the refined cotton prepared by the method is more than 800 mPa·s.

Chinese patent CN200610068484.9 discloses a cotton pulp with high polymerization degree and a method for preparing the cotton pulp with high polymerization degree, and the invention is characterized in that hydrogen peroxide, magnesium sulfate and sodium silicate are used as cooking adjuvants, fatty alcohol-polyoxyethylene ether and sodium dodecyl benzene sulfonate are used as cooking penetrants, and chlorination bleaching is used for bleaching.

All the aforementioned cooking processes focus on the utilization of surfactants, mainly to enhance the penetration of alkali liquor in the process of cooking, which lacks effective control of depolymerization. Meanwhile, due to the faster release of chlorine dioxide in the bleaching process, the depolymerization often can reach 150-300, which affects the production of a high polymerization degree product with a polymerization degree more than 2,800.

SUMMARY

An objective of the present invention is to provide a more optimized process for producing refined cotton with a high polymerization degree, so as to solve the aforementioned shortcomings.

In order to solve the aforementioned technical problems, the present invention adopts the following technical solutions.

A process for producing refined cotton with a high polymerization degree, includes:

a. material selection: selecting a cotton linter without impurities of three kinds of yarns, wherein the cotton linter has a fiber length of 13-15 mm and a maturity of more than 80%;

b. impurity removal: opening and scutching the cotton linter, and removing impurities such as sand, stone, cotton hulls and the like by an impurity remover;

c. impregnation: blending a sodium hydroxide solution with a mass concentration of 1-2.5%, a surfactant with a mass concentration of 0.1-0.2%, a cyclic ketone compound with a mass concentration of 0.1-0.2%, sulfur trioxide with a mass concentration of 0.2-0.5% and hydrogen peroxide with a mass concentration of 30% to form a cooking agent, and uniformly spraying the cooking agent into the cotton linter at a liquid ratio of 1:2.5-4.0;

d. pretreatment: compounding triethanolamine, sodium carbonate, copper sulfate and magnesium oxide in equal proportion to form a cooking compound adjuvant with a mass concentration of 0.2-0.5%, putting the cooking compound adjuvant into a spherical digester together with the cotton linter subjected to the impregnation treatment, heating to 70° C., stopping heating, and subjecting to idling pretreatment for 40-60 min;

e. cooking:

a first stage of temperature rise: uniformly raising the temperature of the spherical digester to 100-110° C. for a temperature rise time controlled within 30-40 min;

a second stage of temperature rise: then uniformly raising the temperature of the spherical digester to 120-130° C. for a temperature rise time controlled within 20-30 min, and keeping at this temperature for 20 min;

f. cooling of the spherical digester: quickly cooling the interior of the spherical digester by pouring condensed water at 10-15° C. into the spherical digester, so that the pressure in the spherical digester drops to zero within 8-15 min and the temperature drops below 60° C., opening a covering cap of the spherical digester to recover alkali liquor and pouring out cotton pulp, and putting the pulp into a container filled with water at a normal temperature for cooling;

g. formulating a chlorine dioxide bleaching stabilization solution:

(1) taking 75-90 parts of deionized water, 2-4 parts of aminoalcohol, 1-2 parts of polyaminoamide, 0.5-1.5 parts of polyvinylpyrrolidone, 0.5-1 part of ethylenediamine tetraacetic acid, 5-8 parts of phosphate and 2-3 parts of potassium hydrogen phthalate, mixing them at the aforementioned proportion of parts by weight, adding into a buffer tank and stirring for 15-60 min, and allowing to stand for 1-2 h to formulate a buffer absorption solution;

(2) preheating a chlorate solution with a mass concentration of 30-40% and a hydrochloric acid solution with a mass concentration of 30-40% to 50-65° C. respectively, and adding the chlorate solution and the hydrochloric acid solution dropwise into a reactor continuously according to a mass ratio of 1:0.8-1.5, to generate a mixed gas of chlorine and chlorine dioxide;

(3) pumping the generated mixed gas of chlorine dioxide and chlorine into a buffer tank in a manner of negative pressure of 0.05-0.08 MPa, circulating for 30 min-60 min, and fully contacting the generated mixed gas with the circularly flowing buffer absorption solution, so that the mixed gas is completely absorbed by the buffer absorption solution to prepare a stable chlorine dioxide bleaching solution with a pH controlled at 7-8; and (4) sealing the formulated stable chlorine dioxide bleaching solution for storage at a temperature of 15-25° C.;

h. a first stage of bleaching: washing the cooked cotton pulp with water for the first time, and conducting first bleaching of the cotton pulp with ethylenediamine tetraacetic acid with a mass concentration of 99.9% and a chlorine dioxide solution with a mass concentration of 1-2% for a time of 20-30 min;

i. alkali treatment: washing the cotton pulp with water for the second time, controlling a pH value at 10-12, and performing alkali treatment with a sodium hydroxide solution with a mass concentration of 30% and a magnesium carbonate solution with a mass concentration of 0.02-0.5% for a time of 10-20 min;

j. a second stage of bleaching: washing the cotton pulp with water for the third time, and conducting second bleaching with a chlorine dioxide solution with a mass concentration of 0.1-0.2% for a bleaching time of 10-20 min, wherein 0.05-0.1% of sodium hypochlorite and 0.01-0.5% of amino hydroxy acid are added in the process of bleaching;

k. dechlorination: washing the cotton pulp with water for the fourth time, conducting dechlorination treatment with a $Na_2S_2O_3$ solution with a mass concentration of 25-30%, washing the cotton pulp with water for the fifth time, and controlling a pH value between 6.8 and 7.0; and 1. rolling and drying by baking: rolling the bleached cotton pulp for dehydration, and finally drying by baking to obtain a finished product with a polymerization degree up to more than 2,800.

In the present patent, the cotton linter is 1 part.

In the present patent, in the process of impregnation, the sodium hydroxide solution is 2.5-4 parts, the surfactant is 0.001-0.003 parts, the cyclic ketone compound is 0.0005-0.002 parts, sulfur trioxide is 0.002-0.005 parts, and hydrogen peroxide is 0.002-0.005 parts.

In the present patent, the cooking compound adjuvant is 0.005-0.01 part.

In the present patent, the surfactant is ethylenediamine tetraacetic acid.

In the present patent, the cyclic ketone compound is any one or more of naphthoquinone, anthraquinone or anthrone.

In the present patent, the cyclic ketone compound is prepared by compounding naphthoquinone, anthraquinone and anthrone in equal proportion.

In the present patent, in the process of the first stage of bleaching, ethylenediamine tetraacetic acid is 0.005-0.008 parts, and the chlorine dioxide solution is 2.5-4.5 parts.

In the present patent, in the process of alkali treatment, the sodium hydroxide solution is 0.025-0.035 parts and the magnesium carbonate solution is 0.004-0.007 parts.

In the present patent, in the second stage of bleaching, the chlorine dioxide solution is 1.25-1.6 parts, sodium hypochlorite is 0.05-0.08 parts, and amino hydroxy acid is 0.005-0.008 parts.

In the present patent, in the process of dechlorination, $Na_2S_2O_3$ is 0.003-0.006 parts.

The beneficial effects that can be achieved in the present invention by adopting the aforementioned technical solutions are as follows.

1. In the present invention, the pretreatment procedure is arranged before cooking, so that the alkali liquor permeability is improved. Meanwhile, rapid cooling of the interior of the spherical digester is conducted after completion of cooking, and cooling treatment is then conducted with water at a normal temperature while the pulp is poured out from the spherical digester, so that the further oxidation and depolymerization of the pulp due to over-high temperature is avoided, so as to ensure the alkalization polymerization degree of the cooking.

2. A variety of adjuvants are adopted to compound the cooking agent, which improves the reaction effect, effectively controls the depolymerization in the cooking process, and can obtain fibers with a high polymerization degree.

3. The staged cooking is adopted to avoid the disadvantage of difficulty in control of depolymerization caused by the traditional one-step cooking manner, and under the protection of the adjuvants, depolymerization can be effectively controlled.

4. Various compound bleaching adjuvants such as magnesium carbonate, sodium hypochlorite and the like are adopted to enhance the bleaching function, inhibit the degradation of cellulose and improve the whiteness of the product.

5. In the present invention, by reducing the reaction between the chlorite and chlorine and introducing chlorine and chlorine dioxide directly into the buffer absorption solution, chlorine is reacted to generate a hypochlorite with a bleaching effect, thereby improving the bleaching effect and storage time of the stable chlorine dioxide bleaching solution while effectively treating chlorine, and meanwhile reducing the difficulty in releasing chlorine dioxide only by using an organic stabilizer in combination with the buffer absorption solution. Hydrochloric acid is used instead of sulfuric acid used in the traditional process, and the preparation cost is reduced.

DETAILED DESCRIPTION

The present invention is further described below with reference to embodiments.

Example 1

A process for producing refined cotton with a high polymerization degree, includes:

a. material selection: selecting 4,000 Kg of a cotton linter without impurities of three kinds of yarns, wherein the cotton linter has a fiber length of 13-15 mm and a maturity of more than 80%;

b. impurity removal: opening and scutching the cotton linter, and removing impurities such as sand, stone, cotton hulls and the like by an impurity remover;

c. impregnation: blending 10,000 Kg of a sodium hydroxide solution with a mass concentration of 1%, 4 Kg of ethylenediamine tetraacetic acid with a mass concentration of 0.1%, 2 Kg of naphthoquinone with a mass concentration of 0.1%, 8 Kg of sulfur trioxide with a mass concentration of 0.2% and 8 Kg of hydrogen peroxide with a mass concentration of 30% to form a cooking agent, and uniformly spraying the cooking agent into the cotton linter at a liquid ratio of 1:2.5;

d. pretreatment: compounding 5 Kg of triethanolamine, 5 Kg of sodium carbonate, 5 Kg of copper sulfate and 5 Kg of magnesium oxide to form a cooking compound adjuvant with a mass concentration of 0.2%, putting the cooking compound adjuvant into a spherical digester together with the cotton linter subjected to the impregnation treatment, heating to 70° C., stopping heating, and subjecting to idling pretreatment for 50 min;

e. cooking:

a first stage of temperature rise: uniformly raising the temperature of the spherical digester to 100-110° C. for a temperature rise time controlled at 35 min;

a second stage of temperature rise: then uniformly raising the temperature of the spherical digester to 120-130° C. for a temperature rise time controlled at 25 min, and keeping at this temperature for 20 min;

f. cooling of the spherical digester: quickly cooling the interior of the spherical digester by pouring condensed water at 10-15° C. into the spherical digester, so that the pressure in the spherical digester drops to zero within 10 min and the temperature drops below 60° C., opening a covering cap of the spherical digester to recover alkali liquor and pouring out cotton pulp, and putting the pulp into a container filled with water at a normal temperature for cooling; wherein by implementing with the aforementioned cooking process, the obtained cotton pulp was 3,000 Kg, and the obtained cooking polymerization degree was 2,968.

g. formulating a chlorine dioxide bleaching stabilization solution:

(1) taking 75 Kg of deionized water, 2 Kg of aminoalcohol, 1 Kg of polyaminoamide, 0.5 Kg of polyvinylpyrrolidone, 0.5 Kg of ethylenediamine tetraacetic acid, 5 Kg of phosphate and 2 Kg of potassium hydrogen phthalate, mixing them at the aforementioned weight ratio, adding into a buffer tank and stirring for 15 min, and allowing to stand for 1 h to formulate a buffer absorption solution;

(2) firstly preheating a chlorate solution with a mass concentration of 30% to 50° C., and then preheating a hydrochloric acid solution with a mass concentration of 30% to 50° C., and then simultaneously adding the aforementioned chlorate solution and hydrochloric acid solution dropwise into a reactor continuously according to a mass ratio of 1:0.8, to generate a mixed gas of chlorine and chlorine dioxide, wherein the adding dropwise of the two ones were started at the same time and ended at the same time;

(3) pumping the aforementioned generated mixed gas of chlorine dioxide and chlorine into a buffer tank in a manner of negative pressure of 0.08 MPa, circulating for 30 min, and fully contacting the generated mixed gas with the circularly flowing buffer absorption solution, so that the mixed gas is completely absorbed by the buffer absorption solution to prepare a stable chlorine dioxide bleaching solution with a pH controlled at 7; and (4) sealing the aforementioned formulated stable chlorine dioxide bleaching solution for storage at a temperature of 15° C.;

h. a first stage of bleaching: washing the cooked cotton pulp with water for the first time, and conducting first bleaching of the cotton pulp with 15 Kg of ethylenediamine tetraacetic acid with a mass concentration of 99.9% and 7,500 Kg of a chlorine dioxide solution with a mass concentration of 1% for a time of 20 min;

i. alkali treatment: washing the cotton pulp with water for the second time, filtering to dryness, controlling a pH value at 10, and performing alkali treatment with 75 Kg of a sodium hydroxide solution with a mass concentration of 30% and 12 Kg of a magnesium carbonate solution with a mass concentration of 0.02% for a time of 10 min;

j. a second stage of bleaching: washing the cotton pulp with water for the third time, and conducting second bleaching with 3,750 Kg of a chlorine dioxide solution with a mass concentration of 0.1% for a bleaching time of 10 min, wherein 150 Kg of 0.05% of sodium hypochlorite and 15 Kg of 0.01% of amino hydroxy acid were added in the process of bleaching;

k. dechlorination: washing the cotton pulp with water for the fourth time, conducting dechlorination treatment with 9 Kg of a $Na_2S_2O_3$ solution with a mass concentration of 25%, washing the cotton pulp with water for the fifth time, and controlling a pH value at 6.8; and l. rolling and drying by baking: rolling the bleached cotton pulp for dehydration, and finally drying by baking to obtain a finished product with a polymerization degree of 2,884.

Example 2

A process for producing refined cotton with a high polymerization degree, includes:

a. material selection: selecting 4,000 Kg of a cotton linter without impurities of three kinds of yarns, wherein the cotton linter has a fiber length of 13-15 mm and a maturity of more than 80%;

b. impurity removal: opening and scutching the cotton linter, and removing impurities such as sand, stone, cotton hulls and the like by an impurity remover;

c. impregnation: blending 12,000 Kg of a sodium hydroxide solution with a mass concentration of 2%, 6 Kg of ethylenediamine tetraacetic acid with a mass concentration of 0.15%, 6 Kg of anthraquinone with a mass concentration of 0.15%, 12 Kg of sulfur trioxide with a mass concentration of 0.4% and 12 Kg of hydrogen peroxide with a mass concentration of 30% to form a cooking agent, and uniformly spraying the cooking agent into the cotton linter at a liquid ratio of 1:3;

d. pretreatment: compounding 7.5 Kg of triethanolamine, 7.5 Kg of sodium carbonate, 7.5 Kg of copper sulfate and 7.5 Kg of magnesium oxide to form a cooking compound adjuvant with a mass concentration of 0.4%, putting the cooking compound adjuvant into a spherical digester together with the cotton linter subjected to the impregnation treatment, heating to 70° C., stopping heating, and subjecting to idling pretreatment for 40 min;

e. cooking:

a first stage of temperature rise: uniformly raising the temperature of the spherical digester to 100-110° C. for a temperature rise time controlled at 30 min;

a second stage of temperature rise: then uniformly raising the temperature of the spherical digester to 120-130° C. for a temperature rise time controlled at 20 min, and keeping at this temperature for 20 min;

f. cooling of the spherical digester: quickly cooling the interior of the spherical digester by pouring condensed water at 10-15° C. into the spherical digester, so that the pressure in the spherical digester drops to zero within 8 min and the temperature drops below 60° C., opening a covering cap of the spherical digester to recover alkali liquor and pouring out cotton pulp, and putting the pulp into a container filled with water at a normal temperature for cooling;

wherein by implementing with the present cooking process, the obtained cotton pulp was 3,000 Kg, and the obtained cooking polymerization degree was 3,034.

g. formulating a chlorine dioxide bleaching stabilization solution:

(1) taking 90 Kg of deionized water, 4 Kg of aminoalcohol, 2 Kg of polyaminoamide, 1.5 Kg of polyvinylpyrrolidone, 1 Kg of ethylenediamine tetraacetic acid, 8 Kg of phosphate and 3 Kg of potassium hydrogen phthalate, mixing them at the aforementioned weight ratio, adding into a buffer tank and stirring for 60 min, and allowing to stand for 2 h to formulate a buffer absorption solution;

(2) firstly preheating a chlorate solution with a mass concentration of 40% to 65° C., and then preheating a hydrochloric acid solution with a mass concentration of 35% to 65° C., and then simultaneously adding the aforementioned chlorate solution and hydrochloric acid solution dropwise into a reactor continuously according to a mass ratio of 1:1.5, to generate a mixed gas of chlorine and chlorine dioxide, wherein the adding dropwise of the two ones were started at the same time and ended at the same time;

(3) pumping the aforementioned generated mixed gas of chlorine dioxide and chlorine into a buffer tank in a manner of negative pressure of 0.05 MPa, circulating for 60 min, and fully contacting the generated mixed gas with the circularly flowing buffer absorption solution, so that the mixed gas is completely absorbed by the buffer absorption solution to prepare a stable chlorine dioxide bleaching solution with a pH controlled at 8; and (4) sealing the aforementioned formulated stable chlorine dioxide bleaching solution for storage at a temperature of 25° C.;

h. a first stage of bleaching: washing the cooked cotton pulp with water for the first time, and conducting first bleaching of the cotton pulp with 20 Kg of ethylenediamine tetraacetic acid with a mass concentration of 99.9% and 11,000 Kg of a chlorine dioxide solution with a mass concentration of 1.5% for a time of 26 min;

i. alkali treatment: washing the cotton pulp with water for the second time, filtering to dryness, controlling a pH value at 11, and performing alkali treatment with 90 Kg of a sodium hydroxide solution with a mass concentration of 30% and 16 Kg of a magnesium carbonate solution with a mass concentration of 0.2% for a time of 14 min;

j. a second stage of bleaching: washing the cotton pulp with water for the third time, and conducting second bleaching with 4,200 Kg of a chlorine dioxide solution with a mass concentration of 0.15% for a bleaching time of 17 min, wherein 190 Kg of 0.06% of sodium hypochlorite and 20 Kg of 0.2% of amino hydroxy acid were added in the process of bleaching;

k. dechlorination: washing the cotton pulp with water for the fourth time, conducting dechlorination treatment with 16 Kg of a $Na_2S_2O_3$ solution with a mass concentration of 27%, washing the cotton pulp with water for the fifth time, and controlling a pH value at 6.9; and l. rolling and drying by baking: rolling the bleached cotton pulp for dehydration, and finally drying by baking to obtain a finished product with a polymerization degree of 2,957.

Example 3

A process for producing refined cotton with a high polymerization degree, includes:

a. material selection: selecting 4,000 Kg of a cotton linter without impurities of three kinds of yarns, wherein the cotton linter has a fiber length of 13-15 mm and a maturity of more than 80%;

b. impurity removal: opening and scutching the cotton linter, and removing impurities such as sand, stone, cotton hulls and the like by an impurity remover;

c. impregnation: blending 16,000 Kg of a sodium hydroxide solution with a mass concentration of 2.5%, 9.2 Kg of ethylenediamine tetraacetic acid with a mass concentration of 0.2%, 8 Kg of anthrone with a mass concentration of 0.2%, 20 Kg of sulfur trioxide with a mass concentration of 0.5% and 20 Kg of hydrogen peroxide with a mass concentration of 30% to form a cooking agent, and uniformly spraying the cooking agent into the cotton linter at a liquid ratio of 1:4;

d. pretreatment: compounding 10 Kg of triethanolamine, 10 Kg of sodium carbonate, 10 Kg of copper sulfate and 10 Kg of magnesium oxide to form a cooking compound adjuvant with a mass concentration of 0.5%, putting the cooking compound adjuvant into a spherical digester together with the cotton linter subjected to the impregnation treatment, heating to 70° C., stopping heating, and subjecting to idling pretreatment for 60 min;

e. cooking:

a first stage of temperature rise: uniformly raising the temperature of the spherical digester to 100-110° C. for a temperature rise time controlled at 40 min;

a second stage of temperature rise: then uniformly raising the temperature of the spherical digester to 120-130° C. for a temperature rise time controlled at 30 min, and keeping at this temperature for 20 min;

f. cooling of the spherical digester: quickly cooling the interior of the spherical digester by pouring condensed water at 10-15° C. into the spherical digester, so that the pressure in the spherical digester drops to zero within 15 min and the temperature drops below 60° C., opening a covering cap of the spherical digester to recover alkali liquor and pouring out cotton pulp, and putting the pulp into a container filled with water at a normal temperature for cooling; wherein by implementing with the present cooking process, the obtained cotton pulp was 3,000 Kg, and the obtained cooking polymerization degree was 2,907.

g. formulating a chlorine dioxide bleaching stabilization solution:

(1) taking 83 Kg of deionized water, 3.2 Kg of aminoalcohol, 1.6 Kg of polyaminoamide, 1.2 Kg of polyvinylpyrrolidone, 0.7 Kg of ethylenediamine tetraacetic acid, 7.3 Kg of phosphate and 2.4 Kg of potassium hydrogen phthalate, mixing them at the aforementioned weight ratio, adding into a buffer tank and stirring for 35 min, and allowing to stand for 1.5 h to formulate a buffer absorption solution;

(2) firstly preheating a chlorate solution with a mass concentration of 36% to 62° C., and then preheating a hydrochloric acid solution with a mass concentration of 40% to 60° C., and then simultaneously adding the aforementioned chlorate solution and hydrochloric acid solution dropwise into a reactor continuously according to a mass ratio of 1:1.2, to generate a mixed gas of chlorine and chlorine dioxide, wherein the adding dropwise of the two ones were started at the same time and ended at the same time;

(3) pumping the aforementioned generated mixed gas of chlorine dioxide and chlorine into a buffer tank in a manner of negative pressure of 0.065 MPa, circulating for 50 min, and fully contacting the generated mixed gas with the circularly flowing buffer absorption solution, so that the mixed gas is completely absorbed by the buffer absorption solution to prepare a stable chlorine dioxide bleaching solution with a pH controlled at 7.5; and (4) sealing the aforementioned formulated stable chlorine dioxide bleaching solution for storage at a temperature of 20° C.;

h. a first stage of bleaching: washing the cooked cotton pulp with water for the first time, and conducting first bleaching of the cotton pulp with 24 Kg of ethylenediamine tetraacetic acid with a mass concentration of 99.9% and 13,500 Kg of a chlorine dioxide solution with a mass concentration of 2% for a time of 30 min;

i. alkali treatment: washing the cotton pulp with water for the second time, filtering to dryness, controlling a pH value at 12, and performing alkali treatment with 105 Kg of a sodium hydroxide solution with a mass concentration of 30% and 21 Kg of a magnesium carbonate solution with a mass concentration of 0.5% for a time of 20 min;

j. a second stage of bleaching: washing the cotton pulp with water for the third time, and conducting second bleaching with 4,800 Kg of a chlorine dioxide solution with a mass concentration of 0.2% for a bleaching time of 20 min, wherein 240 Kg of 0.1% of sodium hypochlorite and 24 Kg of 0.5% of amino hydroxy acid were added in the process of bleaching;

k. dechlorination: washing the cotton pulp with water for the fourth time, conducting dechlorination treatment with 18 Kg of a $Na_2S_2O_3$ solution with a mass concentration of 30%, washing the cotton pulp with water for the fifth time, and controlling a pH value at 7.0; and l. rolling and drying by baking: rolling the bleached cotton pulp for dehydration, and finally drying by baking to obtain a finished product with a polymerization degree of 2,819.

Example 4

A process for producing refined cotton with a high polymerization degree, includes:

a. material selection: selecting 4,000 Kg of a cotton linter without impurities of three kinds of yarns, wherein the cotton linter has a fiber length of 13-15 mm and a maturity of more than 80%;

b. impurity removal: opening and scutching the cotton linter, and removing impurities such as sand, stone, cotton hulls and the like by an impurity remover;

c. impregnation: blending 16,000 Kg of a sodium hydroxide solution with a mass concentration of 2%, 8 Kg of ethylenediamine tetraacetic acid with a mass concentration of 0.12%, a cyclic ketone compound with a mass concentration of 0.16%, 11 Kg of sulfur trioxide with a mass concentration of 0.4% and 10 Kg of hydrogen peroxide with a mass concentration of 30% to form a cooking agent, and uniformly spraying the cooking agent into the cotton linter at a liquid ratio of 1:3, wherein the cyclic ketone compound consisted of 1 Kg of naphthoquinone, 1 Kg of anthraquinone and 1 Kg of anthrone;

d. pretreatment: compounding 7.5 Kg of triethanolamine, 7.5 Kg of sodium carbonate, 7.5 Kg of copper sulfate and 7.5 Kg of magnesium oxide in equal proportion to form a cooking compound adjuvant with a mass concentration of 0.35%, putting the cooking compound adjuvant into a spherical digester according to proportion has together with the cotton linter subjected to the impregnation treatment, heating to 70° C., stopping heating, and subjecting to idling pretreatment for 55 min;

e. cooking:

a first stage of temperature rise: uniformly raising the temperature of the spherical digester to 100-110° C. for a temperature rise time controlled at 30 min;

a second stage of temperature rise: then uniformly raising the temperature of the spherical digester to 120-130° C. for a temperature rise time controlled at 20 min, and keeping at this temperature for 20 min;

f. cooling of the spherical digester: quickly cooling the interior of the spherical digester by pouring condensed water at 10-25° C. into the spherical digester, so that the pressure in the spherical digester drops to zero within 12 min and the temperature drops below 60° C., opening a covering cap of the spherical digester to recover alkali liquor and pouring out cotton pulp, and putting the pulp into a container filled with water at a normal temperature for cooling; wherein by implementing with the present cooking process, the obtained cotton pulp was 3,000 Kg, and the obtained cooking polymerization degree was 2,945.

g. formulating a chlorine dioxide bleaching stabilization solution:

(1) taking 83 Kg of deionized water, 3.2 Kg of aminoalcohol, 1.6 Kg of polyaminoamide, 1.2 Kg of polyvinylpyrrolidone, 0.7 Kg of ethylenediamine tetraacetic acid, 7.3 Kg of phosphate and 2.4 Kg of potassium hydrogen phthalate, mixing them at the aforementioned weight ratio, adding into a buffer tank and stirring for 35 min, and allowing to stand for 1.5 h to formulate a buffer absorption solution;

(2) firstly preheating a chlorate solution with a mass concentration of 36% to 62° C., and then preheating a hydrochloric acid solution with a mass concentration of 40% to 60° C., and then simultaneously adding the aforementioned chlorate solution and hydrochloric acid solution dropwise into a reactor continuously according to a mass ratio of 1:1.2, to generate a mixed gas of chlorine and chlorine dioxide, wherein the adding dropwise of the two ones were started at the same time and ended at the same time;

(3) pumping the aforementioned generated mixed gas of chlorine dioxide and chlorine into a buffer tank in a manner of negative pressure of 0.065 MPa, circulating for 50 min, and fully contacting the generated mixed gas with the circularly flowing buffer absorption solution, so that the mixed gas is completely absorbed by the buffer absorption solution to prepare a stable chlorine dioxide bleaching solution with a pH controlled at 7.5; and (4) sealing the aforementioned formulated stable chlorine dioxide bleaching solution for storage at a temperature of 20° C.;

h. a first stage of bleaching: washing the cooked cotton pulp with water for the first time, and conducting first bleaching of the cotton pulp with 17 Kg of ethylenediamine tetraacetic acid with a mass concentration of 99.9% and 9,500 Kg of a chlorine dioxide solution with a mass concentration of 1.6% for a time of 22 min;

i. alkali treatment: washing the cotton pulp with water for the second time, filtering to dryness, controlling a pH value at 11, and performing alkali treatment with 85 Kg of a sodium hydroxide solution with a mass concentration of 30% and 14 Kg of a magnesium carbonate solution with a mass concentration of 0.3% for a time of 106 min;

j. a second stage of bleaching: washing the cotton pulp with water for the third time, and conducting second bleaching with 3,950 Kg of a chlorine dioxide solution with a mass concentration of 0.13% for a bleaching time of 17 min, wherein 190 Kg of 0.08% of sodium hypochlorite and 17 Kg of 0.09% of amino hydroxy acid were added in the process of bleaching;

k. dechlorination: washing the cotton pulp with water for the fourth time, conducting dechlorination treatment with 14 Kg of a $Na_2S_2O_3$ solution with a mass concentration of 26%, washing the cotton pulp with water for the fifth time, and controlling a pH value at 6.9; and l. rolling and drying by baking: rolling the bleached cotton pulp for dehydration, and finally drying by baking to obtain a finished product with a polymerization degree of 2,896.

Example 5

A process for producing refined cotton with a high polymerization degree, includes:

a. material selection: selecting 4,000 Kg of a cotton linter without impurities of three kinds of yarns, wherein the cotton linter has a fiber length of 13-15 mm and a maturity of more than 80%;

b. impurity removal: opening and scutching the cotton linter, and removing impurities such as sand, stone, cotton hulls and the like by an impurity remover;

c. impregnation: blending 12,000 Kg of a sodium hydroxide solution with a mass concentration of 2.1%, 7 Kg of ethylenediamine tetraacetic acid with a mass concentration of 0.13%, a cyclic ketone compound with a mass concentration of 0.15%, 11 Kg of sulfur trioxide with a mass concentration of 0.3% and 9 Kg of hydrogen peroxide with a mass concentration of 30% to form a cooking agent, and uniformly spraying the cooking agent into the cotton linter at a liquid ratio of 1:3, wherein the cyclic ketone compound is composed of 1 Kg of naphthoquinone, 1 Kg of anthraquinone and 1 Kg of anthrone;

d. pretreatment: compounding 10 Kg of triethanolamine, 10 Kg of sodium carbonate, 10 Kg of copper sulfate and 10 Kg of magnesium oxide to form a cooking compound adjuvant with a mass concentration of 0.4%, putting the cooking compound adjuvant into a spherical digester together with the cotton linter subjected to the impregnation treatment, heating to 70° C., stopping heating, and subjecting to idling pretreatment for 50 min;

e. cooking:

a first stage of temperature rise: uniformly raising the temperature of the spherical digester to 100-110° C. for a temperature rise time controlled at 40 min;

a second stage of temperature rise: then uniformly raising the temperature of the spherical digester to 120-130° C. for a temperature rise time controlled at 30 min, and keeping at this temperature for 20 min;

f. cooling of the spherical digester: quickly cooling the interior of the spherical digester by pouring condensed water at 10-15° C. into the spherical digester, so that the pressure in the spherical digester drops to zero within 10 min and the temperature drops below 60° C., opening a covering cap of the spherical digester to recover alkali liquor and pouring out cotton pulp, and putting the pulp into a container filled with water at a normal temperature for cooling; wherein by implementing with the present cooking process, the obtained cotton pulp was 3,000 Kg, and the obtained cooking polymerization degree was 2,936.

g. formulating a chlorine dioxide bleaching stabilization solution:

(1) taking 83 Kg of deionized water, 3.2 Kg of aminoalcohol, 1.6 Kg of polyaminoamide, 1.2 Kg of polyvinylpyrrolidone, 0.7 Kg of ethylenediamine tetraacetic acid, 7.3 Kg of phosphate and 2.4 Kg of potassium hydrogen phthalate, mixing them at the aforementioned weight ratio, adding into a buffer tank and stirring for 35 min, and allowing to stand for 1.5 h to formulate a buffer absorption solution;

(2) firstly preheating a chlorate solution with a mass concentration of 36% to 62° C., and then preheating a hydrochloric acid solution with a mass concentration of 40% to 60° C., and then simultaneously adding the aforementioned chlorate solution and hydrochloric acid solution dropwise into a reactor continuously according to a mass ratio of 1:1.2, to generate a mixed gas of chlorine and chlorine dioxide, wherein the adding dropwise of the two ones were started at the same time and ended at the same time;

(3) pumping the aforementioned generated mixed gas of chlorine dioxide and chlorine into a buffer tank in a manner of negative pressure of 0.065 MPa, circulating for 50 min, and fully contacting the generated mixed gas with the circularly flowing buffer absorption solution, so that the mixed gas is completely absorbed by the buffer absorption solution to prepare a stable chlorine dioxide bleaching solution with a pH controlled at 7.5; and (4) sealing the aforementioned formulated stable chlorine dioxide bleaching solution for storage at a temperature of 20° C.;

h. a first stage of bleaching: washing the cooked cotton pulp with water for the first time, and conducting first bleaching of the cotton pulp with 22 Kg of ethylenediamine tetraacetic acid with a mass concentration of 99.9% and 11,300 Kg of a chlorine dioxide solution with a mass concentration of 1.8% for a time of 28 min;

i. alkali treatment: washing the cotton pulp with water for the second time, filtering to dryness, controlling a pH value at 11, and performing alkali treatment with 93 Kg of a sodium hydroxide solution with a mass concentration of 30% and 18 Kg of a magnesium carbonate solution with a mass concentration of 0.45% for a time of 106 min;

j. a second stage of bleaching: washing the cotton pulp with water for the third time, and conducting second bleaching with 4,300 Kg of a chlorine dioxide solution with a mass concentration of 0.18% for a bleaching time of 14 min, wherein 220 Kg of 0.09% of sodium hypochlorite and 22 Kg of 0.3% of amino hydroxy acid were added in the process of bleaching;

k. dechlorination: washing the cotton pulp with water for the fourth time, conducting dechlorination treatment with 17 Kg of a $Na_2S_2O_3$ solution with a mass concentration of 28%, washing the cotton pulp with water for the fifth time, and controlling a pH value at 6.9; and l. rolling and drying by baking: rolling the bleached cotton pulp for dehydration, and finally drying by baking to obtain a finished product with a polymerization degree of 2,881.

The above is only the preferred embodiments of the present invention, and does not restrict the present invention in any form. Although the present invention has been disclosed in the preferred embodiments, it is not intended to limit the present invention. Some changes or modifications into equivalent embodiments can be made by those of skills in the art by utilizing the technical content disclosed above without departing from the scope of the technical solution of the present invention, but any simple modifications, equivalent changes and modifications made to the aforementioned embodiments according to the technical essence of the present invention without departing from the content of the technical solution of the present invention are still within the scope of the technical solution of the present invention.

What is claimed is:

1. A process for producing refined cotton with a high polymerization degree, comprising the following steps:

material selection: selecting a cotton linter without impurities of non-cotton fibers, wherein the cotton linter has a fiber length of 13-15 mm and a maturity of more than 80%;

impurity removal: opening and scutching the cotton linter, and removing impurities of sand, stone and cotton hulls by an impurity remover, impregnation: blending a sodium hydroxide solution with a mass concentration of 1-2.5%, an ethylenediamine tetraacetic acid with a mass concentration of 0.1-0.2%, a cyclic ketone compound with a mass concentration of 0.1-0.2%, sulfur trioxide with a mass concentration of 0.2-0.5% and hydrogen peroxide with a mass concentration of 30% to form a cooking agent, and uniformly spraying the cooking agent into the cotton linter at a liquid ratio of 1:2.5-4.0;

pretreatment: compounding triethanolamine, sodium carbonate, copper sulfate and magnesium oxide in equal proportion to form a cooking compound adjuvant with a mass concentration of 0.2-0.5%, putting the cooking compound adjuvant into a spherical digester together with the cotton linter subjected to the impregnation treatment, heating to 70° C., stopping heating, and subjecting to idling pretreatment for 40-60 min;

cooking; wherein, a first stage of temperature rise: uniformly raising the temperature of the spherical digester to 100-110° C. for a temperature rise time controlled within 30-40 min;

a second stage of temperature rise: then uniformly raising the temperature of the spherical digester to 120-130° C. for a temperature rise time controlled within 20-30 min, and keeping at this temperature for 20 min;

cooling of the spherical digester: quickly cooling the interior of the spherical digester by pouring condensed water at 10-15° C. into the spherical digester, so that the pressure in the spherical digester drops to zero within 8-15 min and the temperature drops below 60° C., opening a covering cap of the spherical digester to recover alkali liquor and pouring out cotton pulp, and putting the cotton pulp into a container filled with water at a room temperature for cooling;

formulating a chlorine dioxide bleaching stabilization solution; wherein, (1) taking 75-90 parts of deionized water, 2-4 parts of aminoalcohol, 1-2 parts of polyaminoamide, 0.5-1.5 parts of polyvinylpyrrolidone, 0.5-1 part of ethylenediamine tetraacetic acid, 5-8 parts of phosphate and 2-3 parts of potassium hydrogen phthalate, mixing them at the aforementioned proportion of parts by weight, adding into a buffer tank and stirring for 15-60 min, and allowing to stand for 1-2 h to formulate a buffer absorption solution;

(2) preheating a chlorate solution with a mass concentration of 30-40% and a hydrochloric acid solution with a mass concentration of 30-40% to 50-65° C. respectively, and adding the chlorate solution and the hydrochloric acid solution dropwise into a reactor continuously according to a mass ratio of 1:0.8-1.5, to generate a mixed gas of chlorine and chlorine dioxide;

(3) pumping the generated mixed gas of chlorine dioxide and chlorine into the buffer tank in a manner of negative pressure of 0.05-0.08 MPa, circulating for 30 min-60 min, and fully contacting the generated mixed gas with the buffer absorption solution, so that the mixed gas is completely absorbed by the buffer absorption solution to prepare a stable chlorine dioxide bleaching solution with a pH controlled at 7-8; and (4) sealing the stable chlorine dioxide bleaching solution for storage at a temperature of 15-25° C.;

a first stage of bleaching: washing the cotton pulp after cooking with water for the first time, and conducting first bleaching of the cotton pulp with ethylenediamine tetraacetic acid with a mass concentration of 99.9% and a chlorine dioxide solution with a mass concentration of 1-2% for a time of 20-30 min, alkali treatment: washing the cotton pulp with water for the second time, filtering to dryness, controlling a pH value at 10-12, and performing alkali treatment with a sodium hydroxide solution with a mass concentration of 30% and a magnesium carbonate solution with a mass concentration of 0.02-0.5% for a time of 10-20 min;

a second stage of bleaching: washing the cotton pulp with water for the third time, and conducting second bleaching with a chlorine dioxide solution with a mass concentration of 0.1-0.2% for a bleaching time of 10-20 min, wherein 0.05-0.1% of sodium hypochlorite and 0.01-0.5% of amino hydroxy acid are added in the process of bleaching;

dechlorination: washing the cotton pulp with water for the fourth time, conducting dechlorination treatment with a $Na_2S_2O_3$ solution with a mass concentration of 25-30%, washing the cotton pulp with water for the fifth time, and controlling a pH value between 6.8 and 7.0, so as to form a bleached cotton pulp; and rolling and drying by baking: rolling the bleached cotton pulp for dehydration, and finally drying by baking to obtain a finished product with a polymerization degree up to more than 2,800.

2. The process for producing refined cotton with a high polymerization degree according to claim 1, wherein in the process of impregnation, the sodium hydroxide solution is 2.5-4 parts by weight, the ethylenediamine tetraacetic acid is 0.001-0.003 parts by weight, the cyclic ketone compound is 0.0005-0.002 parts by weight the sulfur trioxide is 0.002-0.005 parts by weight and the hydrogen peroxide is 0.002-0.005 parts by weight.

3. The process for producing refined cotton with a high polymerization degree according to claim 1, wherein in the process of pretreatment, the cooking compound adjuvant is 0.005-0.01 part by weight and the cotton linter is 1 part by weight.

4. The process for producing refined cotton with a high polymerization degree according to claim 1, wherein the cyclic ketone compound is any one or more of naphthoquinone, anthraquinone or anthrone.

5. The process for producing refined cotton with a high polymerization degree according to claim 1, wherein the cyclic ketone compound is prepared by compounding naphthoquinone, anthraquinone and anthrone in equal proportion.

6. The process for producing refined cotton with a high polymerization degree according to claim 1, wherein in the process of the first stage of bleaching, the ethylenediamine tetraacetic acid is 0.005-0.008 parts by weight and the chlorine dioxide solution is 2.5-4.5 parts by weight.

7. The process for producing refined cotton with a high polymerization degree according to claim 1, wherein in the process of alkali treatment, the sodium hydroxide solution is 0.025-0.035 parts by weight and the magnesium carbonate solution is 0.004-0.007 parts by weight.

8. The process for producing refined cotton with a high polymerization degree according to claim 1, wherein in the process of the second stage of bleaching, the chlorine dioxide solution is 1.25-1.6 parts by weight, the sodium hypochlorite is 0.05-0.08 parts by weight and the amino hydroxy acid is 0.005-0.008 parts by weight and in the process of dechlorination, the $Na_2S_2O_3$ is 0.003-0.006 part by weight.

* * * * *